US011530532B2

(12) United States Patent
Birmelin

(10) Patent No.: US 11,530,532 B2
(45) Date of Patent: Dec. 20, 2022

(54) SANITARY OUTLET DEVICE AND SANITARY FITTING

(71) Applicant: Neoperl GmbH, Mullheim (DE)

(72) Inventor: David Birmelin, Mullheim (DE)

(73) Assignee: Neoperl GmbH, Müllheim (DE)

( * ) Notice: Subject to any disclaimer, the term of this patent is extended or adjusted under 35 U.S.C. 154(b) by 697 days.

(21) Appl. No.: 16/315,787

(22) PCT Filed: Sep. 7, 2017

(86) PCT No.: PCT/EP2017/001062

§ 371 (c)(1),
(2) Date: Jan. 7, 2019

(87) PCT Pub. No.: WO2018/050273

PCT Pub. Date: Mar. 22, 2018

(65) Prior Publication Data

US 2021/0277639 A1 Sep. 9, 2021

(30) Foreign Application Priority Data

Sep. 15, 2016 (DE) ..... 20 2016 005 647.7

(51) Int. Cl.

| | |
|---|---|
| ***E03C 1/08*** | (2006.01) |
| ***E03C 1/086*** | (2006.01) |
| ***E03C 1/084*** | (2006.01) |

(52) U.S. Cl.
CPC ..... *E03C 1/086* (2013.01); *E03C 1/084* (2013.01)

(58) Field of Classification Search
CPC ..... E03C 1/086; E03C 1/084; E03C 1/0405; E03C 1/044; E03C 2001/0415; E03C 1/0404
See application file for complete search history.

(56) References Cited

U.S. PATENT DOCUMENTS

| | | | | |
|---|---|---|---|---|
| 6,823,536 | B2 * | 11/2004 | Yip | B05B 1/18 137/551 |
| 8,302,620 | B2 * | 11/2012 | Lin | E03C 1/04 285/376 |
| 8,342,431 | B2 | 1/2013 | Stein et al. | |
| 2011/0266369 | A1 * | 11/2011 | Grether | E03C 1/084 239/428.5 |
| 2014/0263756 | A1 * | 9/2014 | Meehan | B05B 12/0022 239/446 |

FOREIGN PATENT DOCUMENTS

| | | |
|---|---|---|
| DE | 9410918 | 8/1994 |
| DE | 102007025290 | 12/2007 |
| DE | 202009012719 | 1/2010 |
| EP | 3037592 | 6/2016 |

* cited by examiner

*Primary Examiner* — Qingzhang Zhou
(74) *Attorney, Agent, or Firm* — Volpe Koenig

(57) ABSTRACT

In the case of a sanitary outlet device (1), it is provided that a jet former receptacle (3) be formed on a housing (2), in which jet former receptacle an adapter (4) is removably inserted and arranged so as to be rotatable about its axis of rotation (6), wherein the adapter (4) can be rotated between a fixing position, in which the adapter (4) is secured against removal, and a releasing position, in which the adapter (4) is removable (cf. FIG. 1).

19 Claims, 12 Drawing Sheets

SANITARY OUTLET DEVICE AND SANITARY FITTING

BACKGROUND

The invention relates to a sanitary outlet device having a housing, which forms a jet former receptacle into which an adapter is removably inserted, which defines a flow path, wherein the adapter is arranged in the jet former receptacle so as to be rotatable between a fixing position, in which the adapter is locked with the housing and forms a flow resistance in the flow path, and a releasing position, in which the adapter is removable from a jet former receptacle.

The invention also relates to a sanitary fitting having a sanitary outlet device of the type mentioned in the introduction.

It is known to create sanitary outlet devices with which a jet which emerges from a fitting at a fitting outlet is shaped and/or regulated in terms of the throughflow rate. For example, it is known to generate aerated or non-aerated water jets which may be composed of one jet or made up of multiple individual, mutually separate partial jets.

For this purpose, adapters are used which realize the desired jet pattern. In the medical field in particular, it is necessary for such adapters to be exchanged at regular intervals, for example in order to prevent hygienically critical contamination.

DE 10 2007 025 290 A1 has already disclosed a sanitary outlet device of the type mentioned in the introduction, which can be mounted on the water outlet of a sanitary outlet fitting in order to shape the water emerging there into a homogeneous and non-sputtering water jet. The known outlet device has a sleeve-shaped housing which has an internal thread on its inflow-side housing inner circumference, by which internal thread the housing can be screwed onto an external thread on the water outlet of the outlet fitting. The housing of the known outlet device forms a jet former receptacle into which an adapter is removably inserted. The adapter, which is flushed through by the emerging water and thus defines a flow path, is movable in the jet former receptacle of the housing between a fixing position, in which the adapter is locked with the housing and forms a flow resistance in the flow path, and a releasing position, in which the adapter is removable from the jet former receptacle. For this purpose, the adapter has spring arms with externally situated detent projections which, in the fixing position, engage into an encircling detent groove on the sleeve inner circumference of the housing. In order, in the fixing position, to prevent an inward spring deflection of the spring arms and thus a disengagement movement of the detent projections out of the detent groove, a locking element is provided which is guided in axially displaceable fashion in the adapter. Whereas, in the fixing position, the locking element prevents an inadvertent inward spring deflection of the spring arms, the locking element, when it has been displaced in the axial direction into the releasing position, opens up a ring-shaped gap which permits an inward spring deflection of the spring arms and thus a disengagement of the detent projections out of the detent groove. When the detent projections on the spring arms have engaged with detent action into the detent groove in the fixing position, the adapter can be rotated as desired in the water outlet.

By means of the various components which are held movably one inside the other, the known outlet device is relatively cumbersome in terms of production and construction. Since the locking element is guided movably in the ring-shaped gap between the adapter and the spring arms thereof, the locking element can be operated only at the outflow-side end of the adapter, which makes the handling of the known outlet device much more difficult.

SUMMARY

The invention is therefore based on the object of creating a sanitary outlet device of the type mentioned in the introduction in the case of which the adapter can be exchanged conveniently and in a particularly simple manner without the use of tools.

To achieve the stated object in the case of a sanitary outlet device, one or more features according to the invention are provided. In particular, to achieve the stated object, it is thus provided according to the invention, in the case of a sanitary outlet device of the type described in the introduction, that the adapter is arranged in the jet former receptacle so as to be rotatable between a fixing position, in which the adapter is locked with the housing and forms a flow resistance in the flow path, and a releasing position, in which the adapter is removable from the jet former receptacle. It is advantageous here that, in the fixing position, the adapter is fixedly fastenable to the jet former receptacle, such that the flow obstruction or the flow resistance that the adapter forms in the flow path during operation does not result in the adapter moving out of its fixing position of its own accord.

Since the adapter, in the fixing position, is locked with the housing on an outer side of the housing, it is possible for detent element and counterpart detent element in the interior space and in particular in the jet former receptacle to be omitted.

The housing can thus be provided with a smooth internal contour, which forms the fewest possible contamination zones.

The adapter can be transferred by a simple rotation into a releasing position, in which the adapter can be removed.

Thus, no further actuation steps are required for the removal of the adapter. For this purpose, the housing of the outlet device according to the invention has a non-circular contour on an outer side at least in one portion. It is advantageous here that a release of the detent connection can be effected by rotation of the adapter. Here, during a rotation of the adapter, the non-circular contour forces a detent element out of engagement with a counterpart detent element. Thus, a simple way of releasing the abovementioned locking by a rotation of the adapter is described. This may be realized for example by a rotation through less than 270° or less than 180°, for example less than 100°, in particular approximately or exactly 90°. Thus, with a relatively high holding force of the locking action, a low release force is required to transfer the adapter into the releasing position and, there, pull it away from the housing. Tools can be omitted.

In one advantageous refinement, provision may be made whereby the adapter is insertable into the jet former receptacle in an insertion direction oriented counter to a flow direction of the flow path and can be forced out of the jet former receptacle by a flow in the flow path. Thus, the adapter can be easily inserted into the jet former receptacle from below. The existing opening as a water outlet can thus be utilized for the insertion of the adapter. By contrast, the adapter can also be forced out of the jet former receptacle again by a flow in the flow path. Additional measures for the removal of the adapter in its releasing position from the jet former receptacle can thus be omitted. Rather, the adapter can, as soon as it has been transferred into the releasing position, be easily removed by opening the fitting on which said adapter is installed.

One advantage in relation to DE 20 2009 012 719 U1 known in the prior art is that the jet regulator engages with a sealing lip into the passage opening of the attachment component and imparts a sealing action there. In this way, pouch-like chambers in which hygienically critical standing water could accumulate can be avoided up to the point of the sealing boundary.

A further advantage of the invention in relation to the coarse thread proposed in DE 20 2009 012 719 U1 is that the adapter can be inserted in any desired orientation and subsequently transferred by a simple rotation into a detent position.

In one advantageous refinement, provision may be made whereby the adapter engages around the housing. Thus, the adapter can be gripped from all sides outside the housing. It is furthermore advantageous if the detent element and counterpart detent element by which the adapter can be locked on the housing can be formed on the outside on the housing and thus outside the flow path. Potential contamination points in the flow path can thus be avoided.

In one advantageous refinement, provision may be made whereby the adapter is arranged in the jet former receptacle so as to be rotatable about an axis of rotation oriented along the flow path, and whereby the fixing position and the releasing position are arranged at the same height in relation to the insertion direction of the adapter. The adapter can thus be transferred from the fixed position into the releasing position by an actuation movement which is typically easily accessible in the case of fitting outlets, because it can be performed obliquely from above at a downwardly open fitting outlet.

Since, in this embodiment, the fixing position and the releasing position are arranged at the same height in relation to an insertion direction of the adapter, for example the above-mentioned insertion direction or the insertion direction for the abovementioned insertion of the adapter, thread flights or the like on the adapter or on the housing can be omitted. In particular, cumbersome machining of a housing comprised of a metallic material can thus be omitted. The transfer between the positions can thus be performed by a movement which takes place in one axial plane.

In general, provision may be made whereby the adapter is comprised of plastics or a plastics combination and/or the housing is comprised of a metallic material. In particular, a housing comprised of metallic material offers the advantage that it can be easily and thoroughly cleaned. An adapter comprised of plastic offers the advantage that even complex shapes can be realized with relatively little outlay, and/or that an adapter can be produced with relatively low material costs. This facilitates the use of the adapter of a sanitary outlet device according to the invention as a disposable product. An embodiment of all constituent parts comprised of a uniform material facilitates the recycling of the material.

In one advantageous refinement, provision may be made whereby the non-circular contour has a flattening delimited on a circumferential portion and/or a contour/run-on bevel running in a circumferential direction. It is thus possible, for example, for a detent element, which outside the circumferential portion is connected with locking action to the housing, to be removable from the housing in the region of the flattening.

If the non-circular contour has a contour run-on bevel running in a circumferential direction, a detent element can, at the contour run-on bevel, be forced, or be capable of being forced, out of engagement with a counterpart detent element, which may be formed for example on the housing.

In one refinement of the invention, provision may be made whereby the adapter is of non-circular form on an outer side, in particular with at least one protruding handling projection. It is advantageous here that the adapter can be easily gripped in order to impart the above-described rotational movement. It is particularly expedient here if the adapter is equipped with at least one protruding handling projection, preferably with two diametrically mutually oppositely situated, in each case protruding handling projections. Thus, a simple means is provided for transferring the desired rotational movement performing into the releasing position. Through the formation of handling projections or one handling projection, the orientation of, for example, a detent element in the interior of the adapter can furthermore be easily displayed to or easily sensed by the user. This facilitates the correct attachment of the adapter to the jet former receptacle in order to arrive directly at the fixed position without additional rotation.

In one refinement of the invention, provision may be made whereby the detent element is a detent projection, and the counterpart detent element is a detent receptacle, and whereby the counterpart detent element is formed as a groove portion delimited preferably on a circumferential portion. It is advantageous here that a detent projection and a detent receptacle constitute known connecting means for producing a detent connection.

In general, it can be stated that, for example, the detent element may be formed on the adapter and the counterpart detent element may be formed on the housing. In other refinements, the reverse situation may apply.

In this refinement of the invention, provision is made whereby the counterpart detent element is formed as a groove portion. It is thus possible for detent projections or detent lugs to easily lock with the counterpart detent element. It is particularly expedient if the groove portion is delimited on a circumferential portion. It can thus be achieved that the locking can be eliminated, for example by virtue of the detent element being moved out of said circumferential portion, in particular by rotation of the adapter relative to the housing.

In one refinement of the invention, provision may be made whereby the detent element is formed on an inner surface of the adapter. It is advantageous here that the detent element is concealed when in an operational position on the fitting. It is particularly expedient if the detent element is formed on an inner surface, which is preferably of uninterrupted encircling design, of the adapter, if the inner surface defines an inner diameter and/or an inner circumference, which is adapted to an outer diameter and/or an outer circumference of the housing, and if a mounting aid is formed in front of the counterpart detent element in the insertion direction. Thus, in the region of the detent element, the adapter engages around the housing over the full circumference, and thus produces sufficient resistance to overly easy displacement of the detent element in a radially outward direction. This improves the strength of the detent connection between adapter and housing, such that it can be ensured that the adapter is not inadvertently forced out, or cannot inadvertently be forced out, of the jet former receptacle.

Here, provision may be made whereby the inner surface defines an inner diameter, which is adapted to an outer diameter of the housing, that is to say for example corresponds to said outer diameter aside from a predefined fit. It is thus possible, for example, to realize a play-free arrangement of the adapter on the housing in the fixed position, whereby a particularly strong locking action is realized. Alternatively or in addition, provision may be made whereby the inner surface defines an inner circumference which is adapted to an outer circumference of the housing, that is to say for example corresponds to said outer circumference aside from a predefined fit. This constitutes an alternative possibility of realizing virtually or entirely play-free abutment of the adapter against the housing, and may be combined with the refinement above in order to achieve particularly secure hold.

In this refinement of the invention, provision is made whereby a mounting aid is formed in front of the counterpart detent element in the insertion direction. Easy sensing of a correct installation orientation and/or simple alignment of the adapter for the purposes of insertion can thus be realized. Here, the mounting aid may be formed for example as an indentation, if the detent element forms an elevation, for example a detent projection. Engagement of the elevation into the indentation, that is to say a correct installation position, can thus be easily sensed by rotating the adapter. Conversely, the mounting aid may also be formed as an elevation, if this fits with the inner contour of the adapter and in particular with the detent element, for example a detent groove.

In one refinement of the invention, provision may be made whereby the detent projection has a detent projection run-on bevel which is oriented in the insertion direction and which preferably adjoins the inner surface. This may facilitate locking of the adapter on the housing.

In one refinement of the invention, provision may be made whereby the counterpart detent element is formed on the outer side of the housing and has a counterpart detent element run-on bevel. Thus, the counterpart detent element can be formed outside the flow path, such that unnecessary contamination points can be avoided. In particular, provision may be made here whereby the counterpart detent element has a counterpart detent element run-on bevel. This facilitates locking of detent element and counterpart detent element during the connection of the adapter to the housing.

In one refinement of the invention, provision may be made whereby the jet former receptacle is formed so as to widen in a flow direction. This permits sealing insertion of the adapter into the jet former receptacle even in the case of manufacturing tolerances of the adapter.

In one refinement of the invention, provision may be made whereby the adapter is, in the inserted state, deformed at its inflow-side end by the jet former receptacle. Thus, a simple means of enabling the adapter to bear sealingly against the jet former receptacle is described. It is particularly expedient here if the jet former receptacle is, for this purpose, designed to widen in a flow direction. Thus, a desired deformation can be easily realized during the insertion of the adapter into the jet former receptacle, for example by virtue of the adapter being manufactured with an oversize in relation to the position it assumes upstream of the jet former receptacle and deformed dimensions.

In one refinement of the invention, provision may be made whereby the adapter has, at its inflow-side end, an elastic sealing lip, which bears against the jet former receptacle, and/or a sealing ring, which bears against the jet former receptacle and which is held axially on a jet former. If the adapter has a sealing lip which bears against the jet former receptacle, an intermediate space between the adapter and the jet former receptacle can be easily sealed off. It is particularly expedient here if the sealing lip is formed on an inflow-side end of the adapter. It is advantageous here that no gap regions between adapter and jet former receptacle are accessible from the flow path. Alternatively or in addition, provision may be made whereby the sealing lip is elastic. This permits an easy deformation of the adapter, for example in the case of the above-described widening form of the jet former receptacle. For example, the elastic sealing lip may be of rubber-free form, in order to avoid or at least reduce settling of bacteria on the sealing lip.

Alternatively or in addition, provision may be made whereby the adapter preferably has, at its inflow-side end, a sealing ring which bears against the jet former receptacle. A particularly well-sealed closure can thus be realized with simple means. The sealing ring is preferably held on one side or even on both sides axially on the jet former in order to hold the sealing ring on the jet former during the insertion into the jet former receptacle or even during the insertion into and removal from the jet former. Thus, contact of water with the sealing ring, which may be manufactured from rubber, is tolerable, because the sealing ring is always exchanged with the jet former. This may be ensured for example by a holding action on both sides on the jet former. Here, the sealing ring may be held axially on one side (for an insertion into or a removal from the jet former receptacle with the jet former), preferably by a shoulder or at least one radially protruding projection, or on both sides (for an insertion into and a removal from the jet former receptacle with the jet former), preferably by two oppositely directed shoulders which receive the sealing ring between them, or by at least two projections which protrude radially, are axially spaced apart from one another and/or receive the sealing ring between them. For example, the sealing ring may be manufactured from rubber even if it comes into contact with water during use, because said sealing ring is frequently exchanged.

It is particularly expedient if a sealing lip integrally formed on the jet former is positioned in front of the sealing ring, for example as already described. The advantages of a sealing lip, specifically in particular the hygienic safety, can therefore be combined with the advantages of a sealing ring, specifically in particular the increased sealing action.

In one refinement of the invention, provision may be made whereby the adapter is manufactured from plastic. This permits relatively free shaping of the adapter in order to realize a desired jet pattern.

Provision may be made whereby the adapter has a jet former, in particular a flow regulator or jet aerator. This makes it possible, with the adapter, to set a desired upper limit for a throughflow rate. Alternatively or in addition, the adapter may be designed as an aerated adapter. An aerated adapter makes it possible here to admix air in order to generate a soft water jet. The adapter may also additionally or alternatively, depending on requirements, be equipped with further functional units, for example a throttle.

It is particularly expedient if the detent element has at least two detent projections which engage on the housing preferably on mutually opposite sides, and/or the counterpart detent element has at least two detent recesses arranged preferably on mutually opposite sides. If the detent element has at least two detent projections which engage on the housing, a secure holding action in the fixed position with active locking is made possible. Provision may be made here for the detent element to be formed on two mutually opposite sides on the housing. Thus, it is possible to realize a holding action on the housing on two sides, which—in the fixed position—permits a particularly secure hold of the adapter on the housing. It is thus for example possible to achieve a holding action of the adapter even in the presence of high water pressures.

It is thus also possible for at least four detent elements and/or matching counterpart detent elements to be formed. Correspondingly, at least four handling projections may be formed, which are ideally spaced apart uniformly from one another.

In one refinement of the invention, provision may be made whereby the counterpart detent element has at least two detent recesses. Locking is thus made possible at two mutually spaced apart points. The counterpart detent elements are preferably arranged on mutually opposite sides of the housing. It is particularly expedient here if the detent element correspondingly likewise has two detent projections which engage on the housing on mutually opposite sides.

It is also possible for three or more than three detent elements—preferably distributed uniformly along a circumference—and corresponding counterpart detent elements to be formed.

In general, it can be stated that it is expedient for numerous different detent elements to be distributed in the circumferential direction. In this way, the most uniform possible holding action of the sealing lip or of the sealing ring in the interior of the jet former receptacle can be achieved. To reinforce the adapter, the abovementioned handling projections and/or other material thickenings may be provided on the outer side, for example in order to increase a restoring force of the detent element.

In one refinement of the invention, provision may be made whereby the inner surface describes a portion of a body of revolution between two detent elements which are adjacent in a circumferential direction. It is advantageous here that a rotational movement can be easily guided. Alternatively or in addition, provision may be made whereby the outer surface of the housing describes a portion of a body of revolution between two counterpart detent elements which are adjacent in the circumferential direction. Here, too, easy guidance of a rotational movement is made possible. It is particularly expedient if the inner surface and the outer surface describe the shape of a body of revolution in said sections. It is thus possible for the inner surface and the outer surface to slide on one another in order to guide the rotational movement of the adapter.

In one refinement of the invention, provision may be made whereby the housing has, at an inflow-side end of the flow path, a fitting receptacle with a thread, which can be screwed together with a counterpart thread of a fitting outlet. It is advantageous here that the housing is easily fastenable to fitting outlets which have a thread. The housing is thus likewise exchangeable.

In one refinement of the invention, provision may be made whereby a jet-altering inner part is detachably inserted as an insert cartridge in the adapter. Thus, the adapter can be equipped with a functionality by which a desired jet characteristic, for example in degree of air admixing, a cross-sectional shape, a flow speed, a flow profile and/or a throughflow rate, can be set. It is thus possible, by exchanging the adapter, to easily alter or renew a desired functionality. For example, in a simple case in terms of construction, the adapter may be formed as with a star-shaped regulating member. It is particularly expedient if the inner part is integrally connected to the adapter.

In one refinement of the invention, provision may be made whereby a jet-altering inner part is arranged so as to be detachably connected to the adapter. It is advantageous here that, in the event of an exchange of the inner part, the adapter can be reused. It is thus also the case that, for a multiplicity of different inner parts, only one common adapter has to be stocked. This simplifies stock-keeping. The jet altering inner part may for example be in the form of an insert cartridge and inserted into the adapter.

In one refinement of the invention, provision may be made whereby the detent element and/or the counterpart detent element define a release angle of greater than 90°. It is advantageous here that a high holding force can be generated. The release angle may for example by an angle enclosed by the insertion direction and an oblique surface that accommodates the holding force, wherein in particular, the angle lies in the material and/or an angle of greater than 90° indicates an oblique inclination of the detent element toward the counterpart detent element (or vice versa).

To achieve the stated object, the invention furthermore provides a sanitary fitting with a sanitary outlet device according to the invention, in particular as described above and/or as claimed in any of the claims directed to a sanitary outlet device, wherein the sanitary outlet device is screwed to a fitting outlet of the sanitary fitting. The sanitary outlet device is thus easily retrofittable. Provision may alternatively be made for the housing of the sanitary outlet device to be formed integrally on a fitting outlet of the sanitary fitting. The housing is thus arranged on the sanitary fitting such that said housing cannot be exchanged, or cannot be removed without being destroyed.

A preferred use, which may possibly be of independently inventive quality, of an adapter may provide for the adapter to be used for forming a sanitary outlet device according to the invention, in particular as described above and/or as claimed in any of the claims directed to a sanitary outlet device, and/or a sanitary fitting according to the invention, in particular as described above and/or as claimed in the claim directed to a fitting. The adapter may in this case have the physical and/or functional features, described above and/or in the following figure description, of the adapter of the sanitary outlet device. In particular, provision may thus be made here for the adapter to be transferred by a rotational movement between a fixing position and a releasing position. In particular, the adapter may be formed with a detent element which is configured and designed for producing a detent connection with a counterpart detent element. It is expedient if the counterpart detent element is oriented outward and the detent element is oriented correspondingly inward, for example on the abovementioned inner surface, in order to attain the described advantages. The adapter may, in the manner described, have a jet-altering inner part, for example an insertable inner part.

BRIEF DESCRIPTION OF THE DRAWINGS

The invention will now be described in more detail on the basis of exemplary embodiments, but is not restricted to these exemplary embodiments. Further exemplary embodiments will emerge from combinations of the features of individual or several patent claims with one another and/or with individual or several features of the exemplary embodiments.

In the figures.

DETAILED DESCRIPTION

Figure 1:
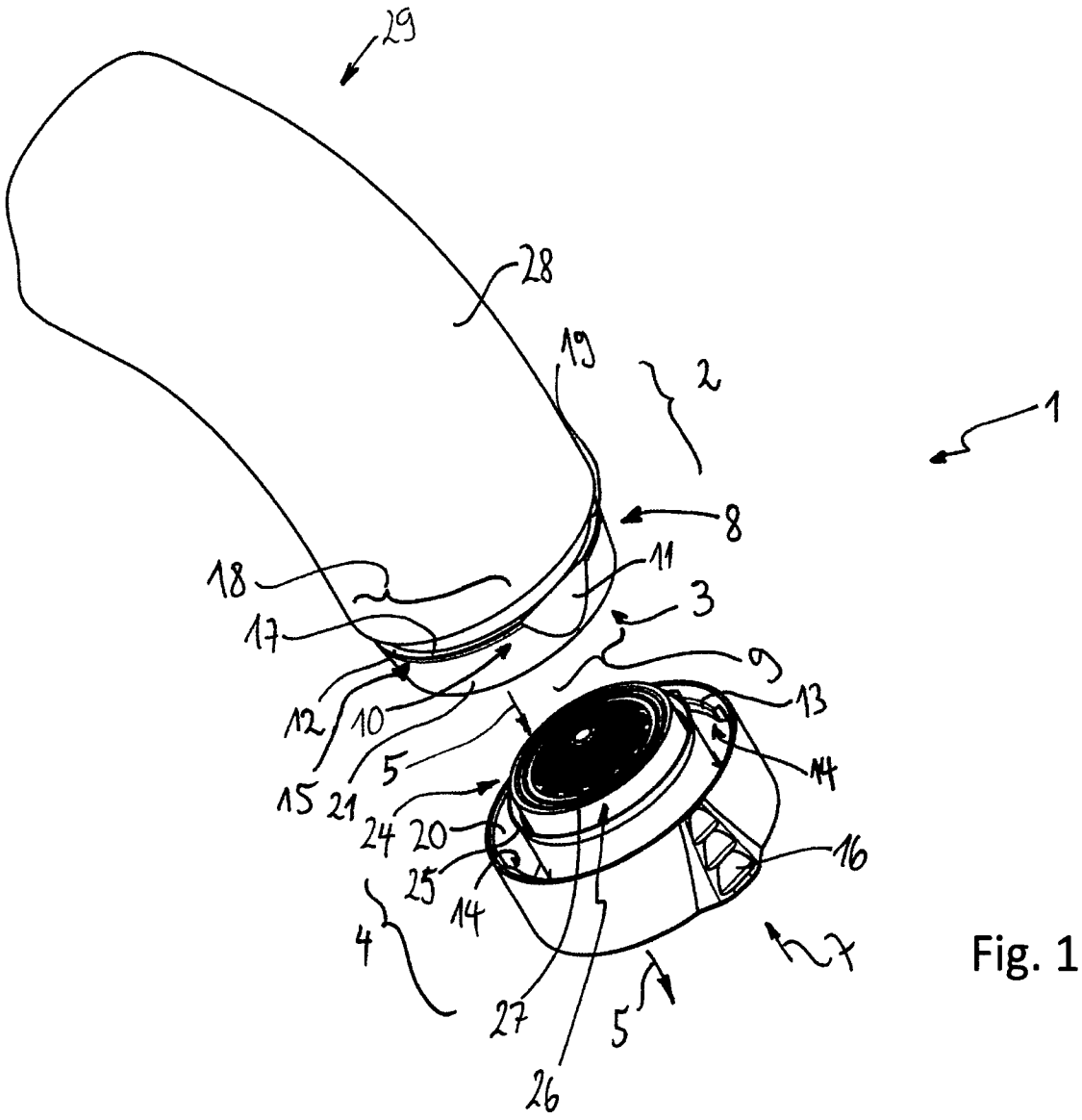
FIG. 1 shows a sanitary outlet device according to the invention with an adapter removed.

Below, FIGS. 1 to 5 will firstly be described jointly.

A sanitary outlet device denoted as a whole by 1 has a housing 2. A jet former receptacle 3 is formed on the housing 2 at the inner side.

An adapter 4 is inserted into the jet former receptacle 3, which adapter is removable from the jet former receptacle 3 in a manner to be described in more detail below.

The adapter 4 defines a flow path 5 for throughflowing water. For this purpose, the adapter 4 is equipped with a jet-altering inner part 31, which may for example form a star-shaped regulating member, a jet regulator, a jet limiter and/or a jet former. Said inner part 31 is, as an insert cartridge 32, inserted into a cartridge receptacle 33 as far as a stop 34. Here, the insertion is performed in a flow direction of the flow path 5, such that the insert cartridge 32 is held in its use position by the stop 34.

Figure 2:
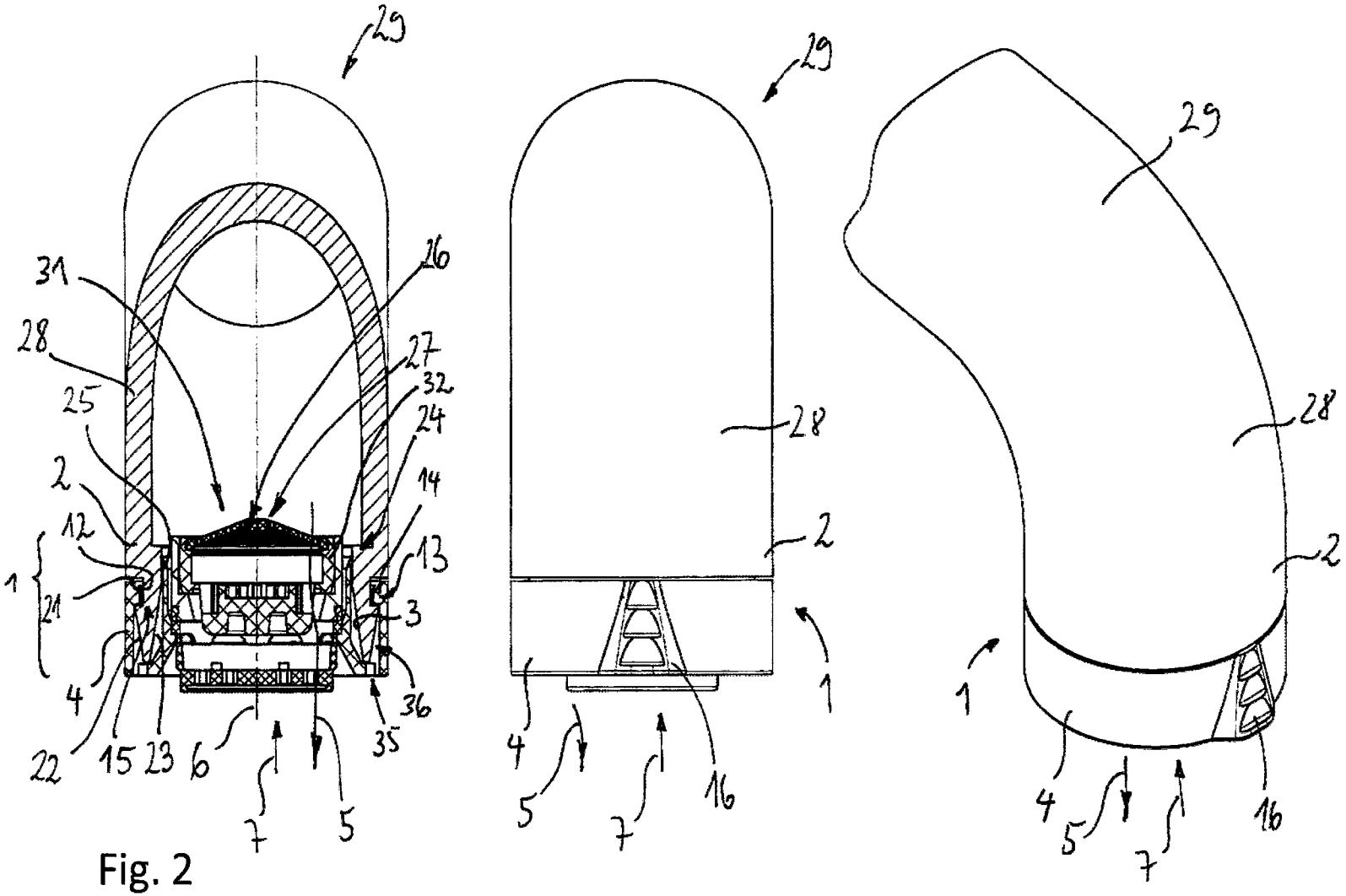
FIG. 2 shows the outlet device as per FIG. 1 in a sectional view, front view and three-dimensional perspective view, with an adapter mounted.

The adapter 4 is, in a fixing position as per FIG. 2, locked with the housing 2 in a manner to be described in more detail. The adapter 4 can be transferred by a rotation into the position as per FIG. 3, in which the adapter 4 can be pulled away from the housing 2 and thus out of the jet former receptacle 3. This position as per FIG. 3 is thus a releasing position of the adapter 4.

Figure 3:
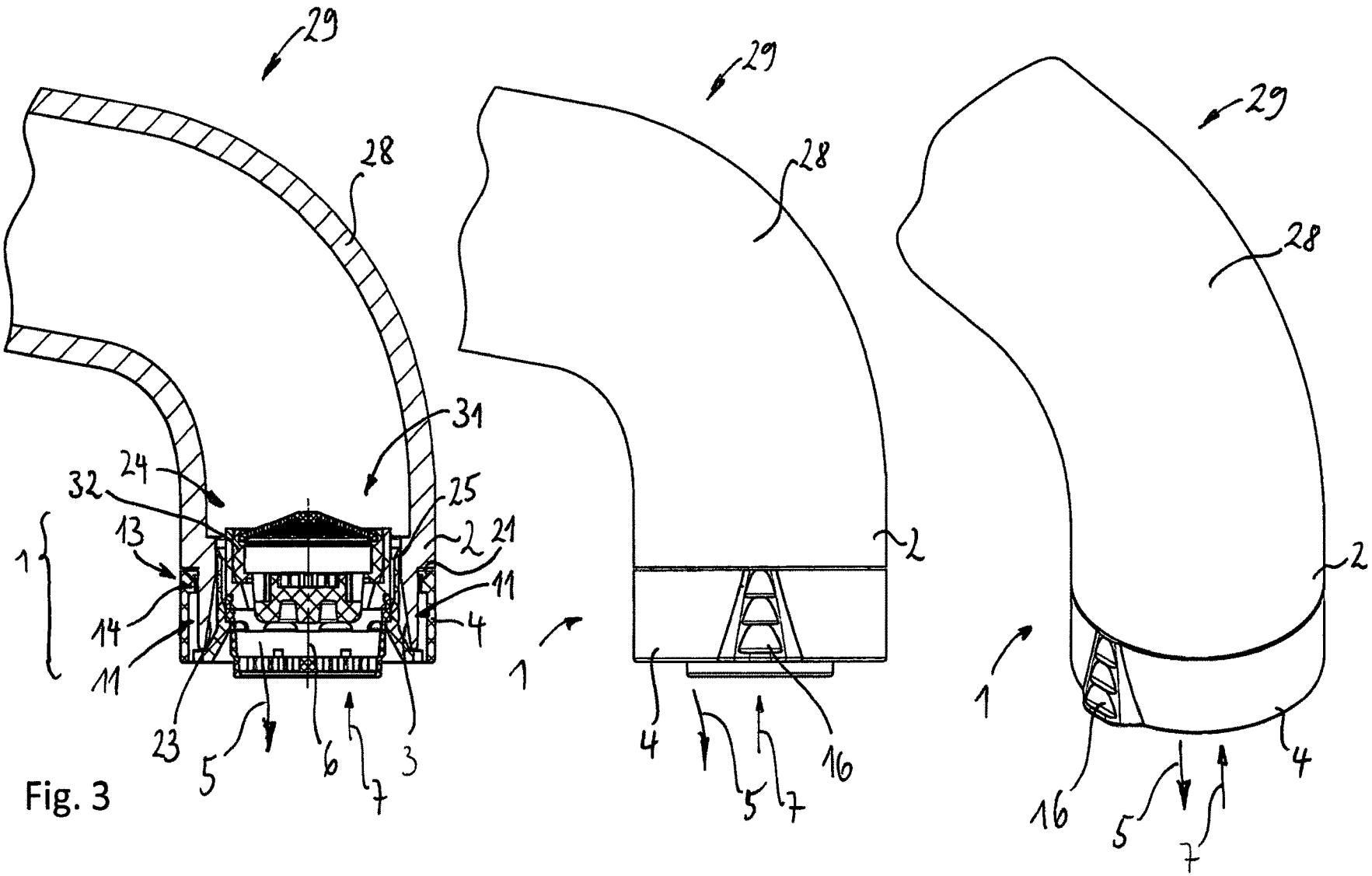
FIG. 3 shows the outlet device as per FIG. 1 in a sectional illustration with a section plane rotated through 90° in relation to FIG. 2, side view and three-dimensional perspective view analogous to FIG. 2, wherein the adapter is arranged in the jet former receptacle, having been rotated through 90°, of the releasing position.
Figure 4:
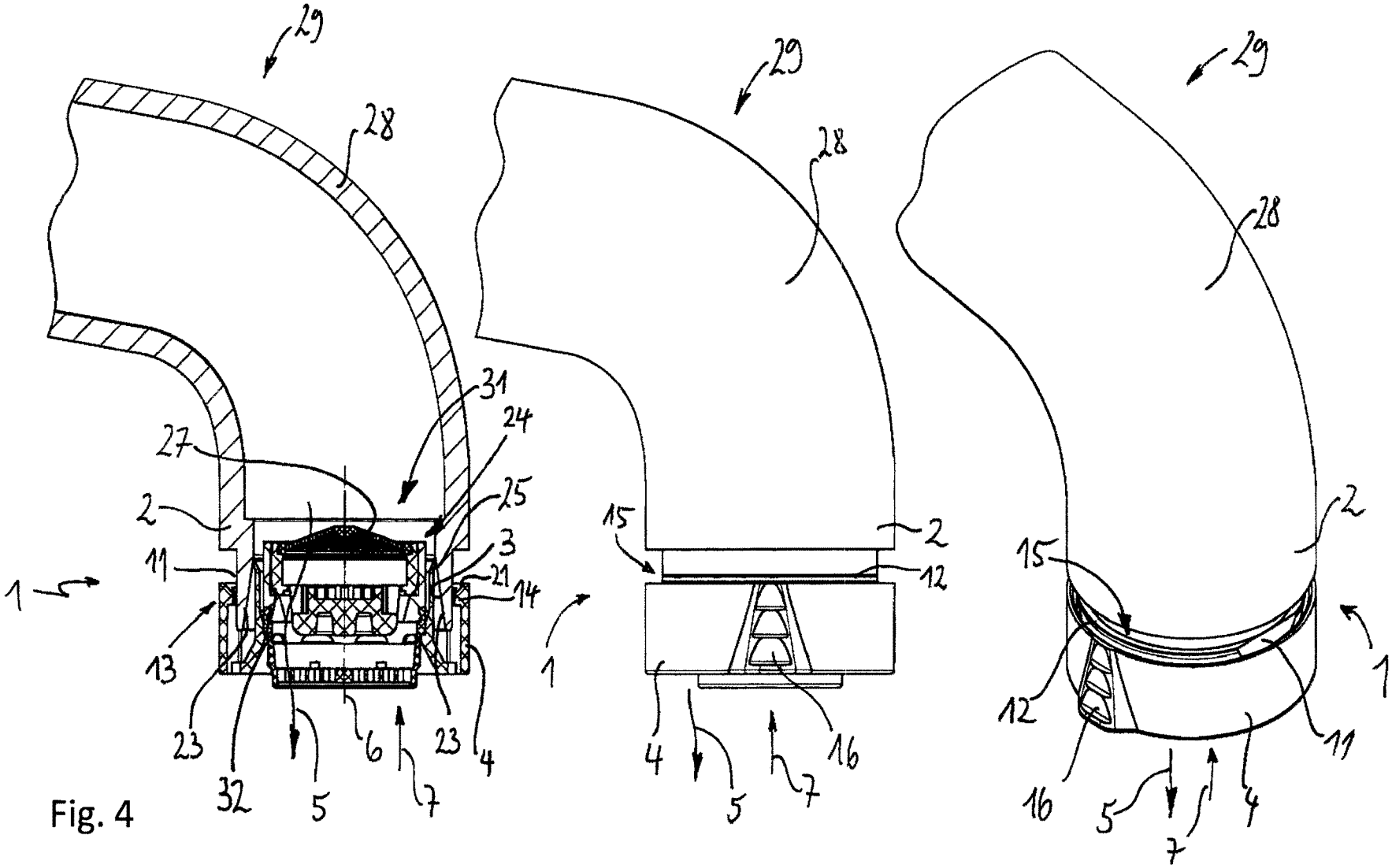
FIG. 4 shows the view as per FIG. 3, wherein the adapter has been partially pulled away from the housing.
Figure 5:
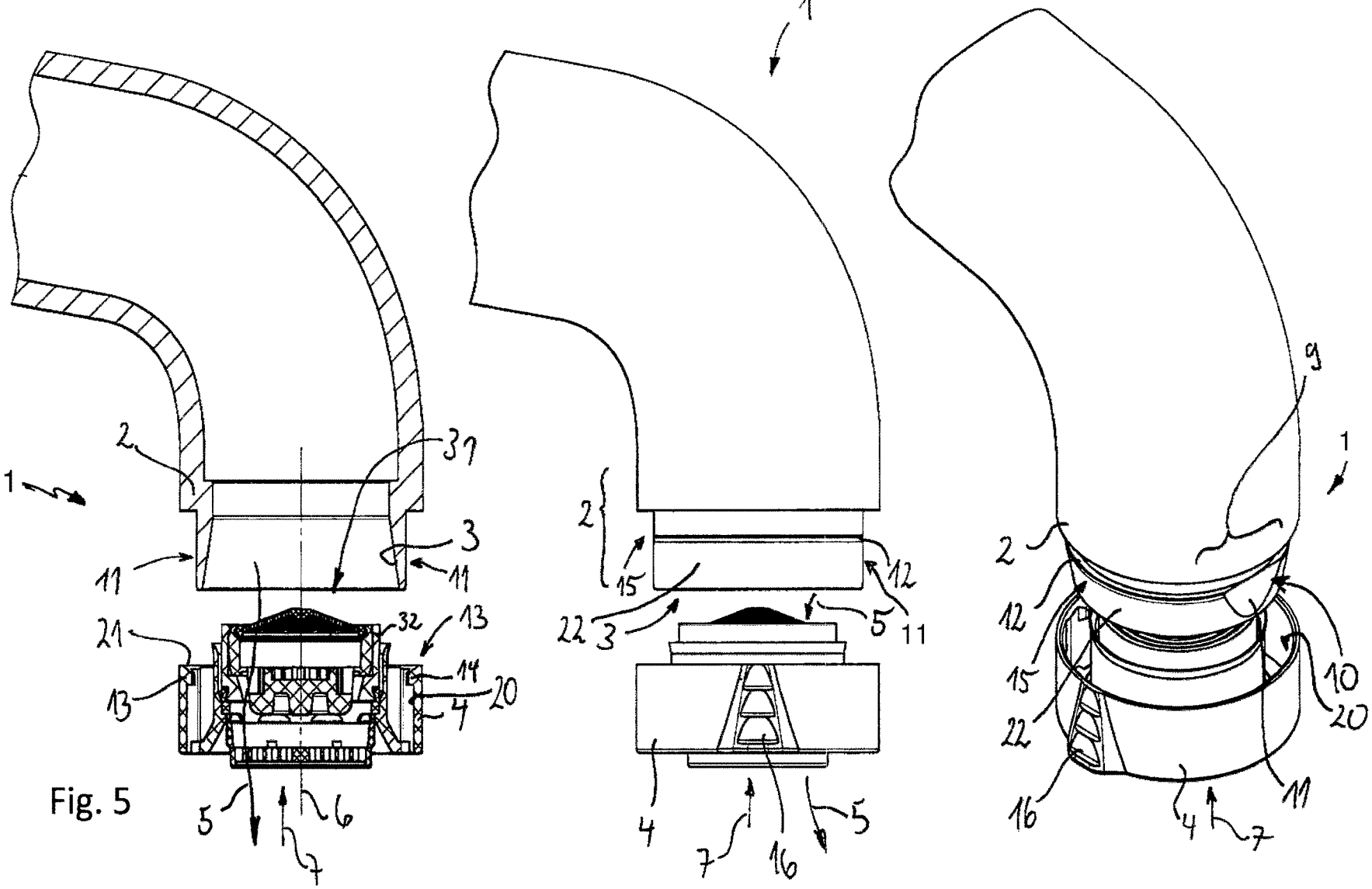
FIG. 5 shows the views as per FIG. 3, wherein the adapter has been pulled completely away from the housing.

Viewing the arrangements as per FIG. 5, FIG. 4 and FIG. 3 together, it can be seen that the adapter 4 is insertable into the jet former receptacle 3 counter to a flow direction of the flow path 5. Once the releasing position as per FIG. 3 has been assumed, the adapter 4, which constitutes a flow obstruction in the flow path 5, is forced out of the jet former receptacle 3.

In particular from the completely pulled-away illustration as per FIG. 1 and FIG. 5, it can be seen that the adapter 4 engages around the housing 2 along the entire circumference.

The adapter 4 is arranged so as to be rotatable about an axis of rotation 6 which is oriented along the flow path 5. By this rotation, the adapter 4 can be adjusted between the fixing position and the releasing position.

In relation to said axis of rotation 6, the fixing position as per FIG. 2 and the releasing position as per FIG. 3 are arranged at the same height. Here, the axis of rotation 6 also predefines an insertion direction 7 of the adapter 4 for the insertion into the jet former receptacle 3, such that the fixed position and the releasing position are also arranged at the same height in relation to said insertion direction 7. A transfer movement between the positions thus runs in an axial plane.

In the fixing position, the adapter 4 is locked with the housing 2 on an outer side 8 of the housing 2. For this purpose, a non-circular contour 10 is formed on the outer side 8 at least in one portion 9.

In the exemplary embodiment, said contour 10 is formed by a flattening 11, which interrupts an otherwise encircling groove 12.

It is achieved in this way that, during a rotation of the adapter 4 about the axis of rotation 6, a detent element 13, which in the form of a detent projection 14 engages with detent action into the groove 12 as counterpart detent element 15, is released in the region of the flattening 11. Thus, as soon as the detent element 13 is positioned over the flattening 11, the adapter 4 can be removed from the housing 2. For as long as the detent element 13 is locked with the counterpart detent element 15, the adapter 4 cannot be removed, and the adapter 4 is fixed in the jet former receptacle 3.

The adapter 4 itself is, on the outer side, of non-circular form and has two diametrically mutually oppositely situated handling projections 16. At these handling projections, a user can easily grip the adapter 4 in order to rotate it about the axis of rotation 6 between the fixing position and the releasing position.

It can also be seen in FIG. 1 that the groove 12, as a groove portion 17, is delimited on a circumferential portion 18 of the housing 2. This delimitation is realized at two sides by in each case one flattening 11.

In this way, the releasing position can be assumed in two positions offset by 180°, because the detent element 14, which are likewise delimited in the circumferential direction, can be pulled away from the housing 2 over the flattenings 11.

Said groove portion 17 thus forms a detent receptacle 19 for the detent projection 14.

It can also be seen in FIG. 1 that the detent element 14 is formed on an inner surface 20 of the adapter 4. The inner surface 20 is of uninterrupted encircling form.

This gives rise to particularly good resistance to deformation of the detent projections 14 in a radially outward direction. The locking is thus maintained in a particularly effective manner.

The inner diameter and the inner circumference of said inner surface 20 are in this case adapted to the outer diameter and the outer circumference on the outer side 8 of the housing, such that, in the locked, that is to say fixing, position, the inner surface 20 bears areally against the outer side 8.

The inner surface 20 is thus, between the detent projections 14, supported on the housing 2, whereby increased strength of the locking is realized.

To facilitate locking during the mounting of the adapter 4, a detent projection run-on bevel 21 is formed on the detent projection, which detent projection run-on bevel is oriented in the insertion direction 7 and interacts with a counterpart detent element run-on bevel on the outer side 8 in the region of the counterpart detent element 15.

On the adapter 4, on the outlet side, there is also formed at least one access opening 35 via which a pointed tool can be inserted. Thus, supported for example on the counterpart detent element run-on bevel which serves as guide bevel 36, or in further exemplary embodiments on a separate guide bevel, the detent element 13 can, even without rotation of the adapter 4, be moved out of a position of engagement with the counterpart detent element 15 in order to pull the adapter 4 away.

The jet former receptacle 3 has an inner cone 23, by which said jet former receptacle is formed so as to widen in a flow direction, that is to say along the flow path 5.

The adapter 4 is dimensioned such that it is deformed by the inner cone 23 during insertion into the jet former receptacle 3.

For this purpose, the adapter 4 has, on its inflow-side end 24, 20 an encircling sealing lip 25 comprised of an elastic, rubber-free material, for example comprised of plastic, which is deformed radially inward by the inner cone 23. The sealing lip 25 thus bears sealingly against the jet former receptacle 3.

The inflow-side end 24 of the adapter 4 and the inner surface 20 of the adapter 4 thus receive the housing 2 between them. Here, the adapter 4 may be manufactured from plastic, and may for example have a flow regulator 26 (known per se and not visible in any more detail here) or similar jet former, for example a jet aerator, behind an upstream screen 27 in the interior, approximately at the position denoted by the arrow.

The adapter 4 may additionally or alternatively be formed as an aerated adapter 4, in a manner known per se.

It can also be seen from the figures that the abovementioned inner surface 20 and the outer side 8 each describe, outside the detent element 13 or the counterpart detent element 15, a portion of a body of revolution.

In the exemplary embodiment as per FIG. 1 to FIG. 5, the housing is formed integrally with a fitting outlet 28 of a sanitary fitting 29 which is merely indicated here.

In further exemplary embodiments, the housing 2 may, in a manner known per se, have a thread which can be screwed 15 together with a counterpart thread of the fitting outlet 28.

Figure 6:
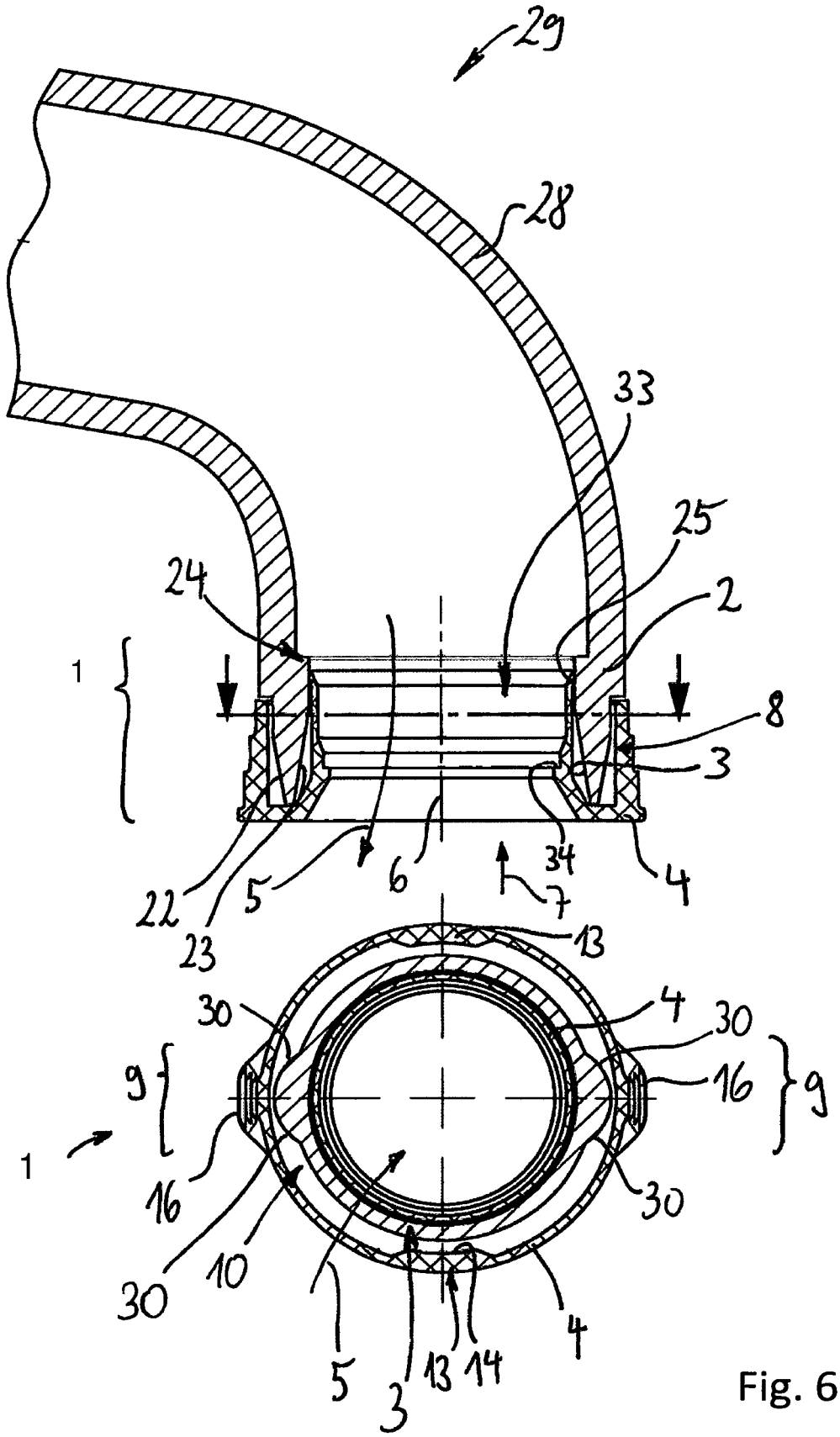
FIG. 6 shows a longitudinal sectional illustration and a cross-sectional illustration of a further sanitary outlet device according to the invention.

FIG. 6 shows a further exemplary embodiment according to the invention of a sanitary outlet device. Components and functional units which are similar or identical in terms of function and/or construction to the preceding exemplary embodiments are denoted by the same reference designations, and will not be separately described again. The statements relating to the exemplary embodiments above therefore apply correspondingly to FIG. 6.

The exemplary embodiment as per FIG. 6 differs from the preceding exemplary embodiments in that the non-circular contour 10 is formed with a contour run-on bevel 30. The contour run-on bevels 30 have the effect that the detent 30 projections 14 of the detent element 13 are forced radially out of the groove portions, which in this case are formed analogously to the groove portions 17 in the preceding figures. Thus, the locking is released, and the adapter 4, which is shown in FIG. 6 in the locked, fixing position, can be pulled away from the housing 2.

In the exemplary embodiments shown and described, the detent element 13 is formed on the adapter 4, whereas the counterpart detent element 15 is formed on the housing 2. In further exemplary embodiments, the detent element 13 is formed as a detent projection 14 on the housing 2, whereas corresponding groove portions 17 are formed in the inner surface 20 in order to realize a detent receptacle 19 and thus a counterpart detent element 15. In this case, too, provision may be made whereby, in the inner surface 20, corresponding contour run-on bevels 30 or other non-circular contours 10 are formed in order, in one portion 9 in the circumferential direction of the inner surface 20, to realize a location at which the locking can be eliminated. This location in this case defines the releasing position, whereas the other angular positions of the adapter 4 in the jet former receptacle 3 form the fixing positions. In further exemplary embodiments, other combinations, known per se, of detent element and counterpart detent element are realized.

Figure 8:
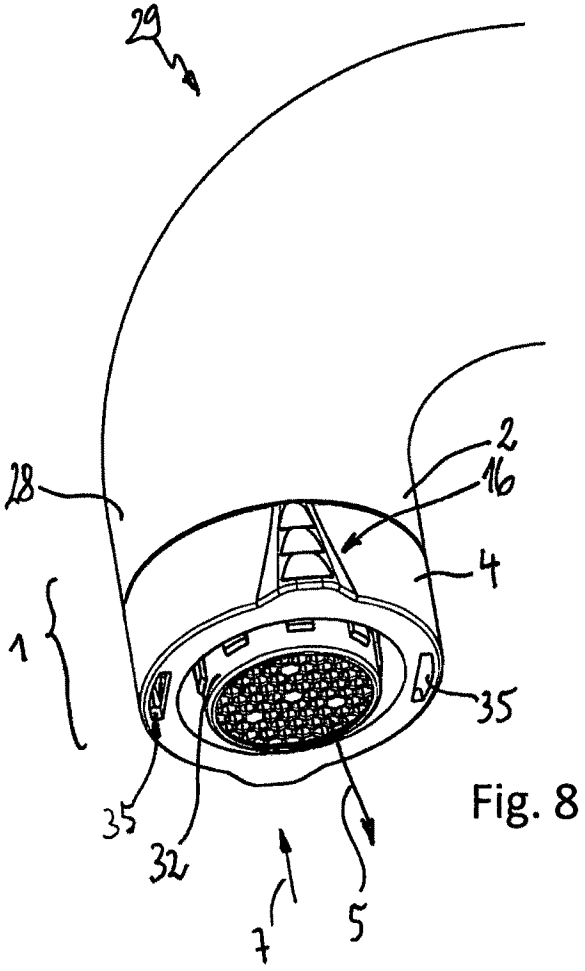
FIG. 8 shows a three-dimensional oblique view from the outside of the outlet device as per FIG. 7.
Figure 7:
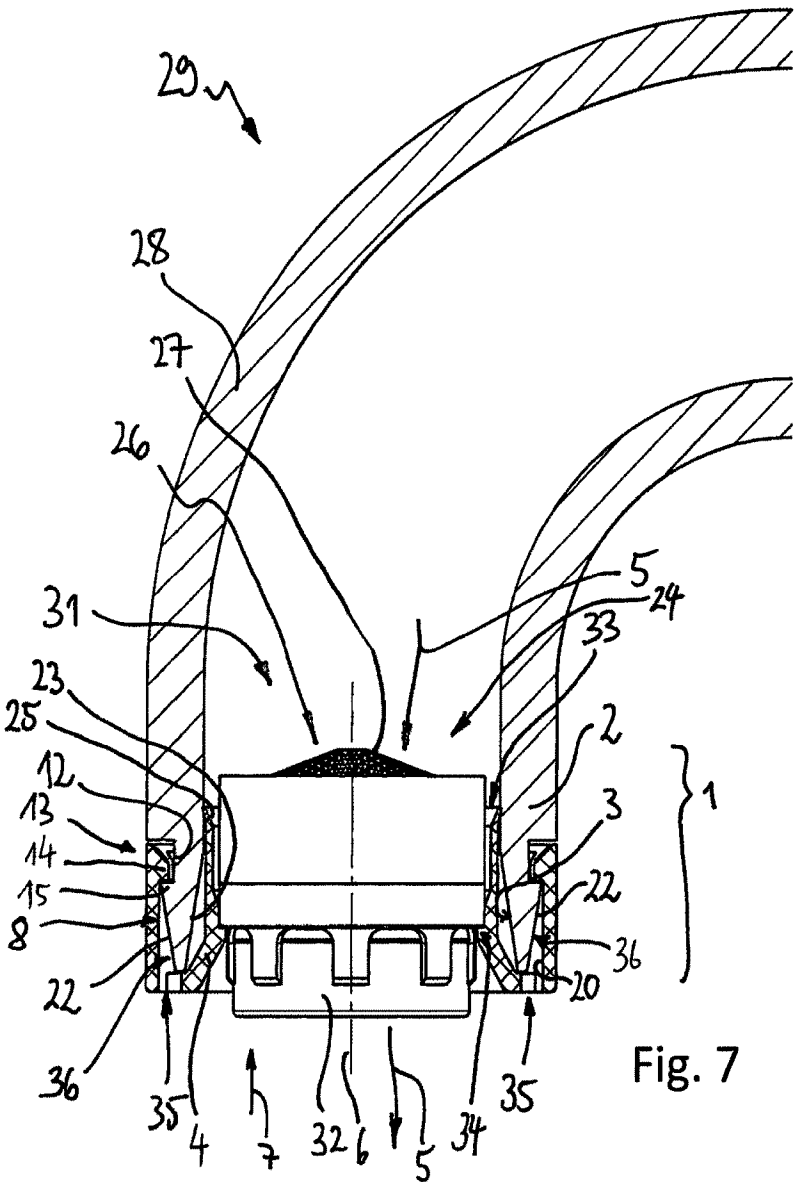
FIG. 7 shows a longitudinal sectional illustration of a fitting with a further sanitary outlet device according to the invention.
Figure 9:
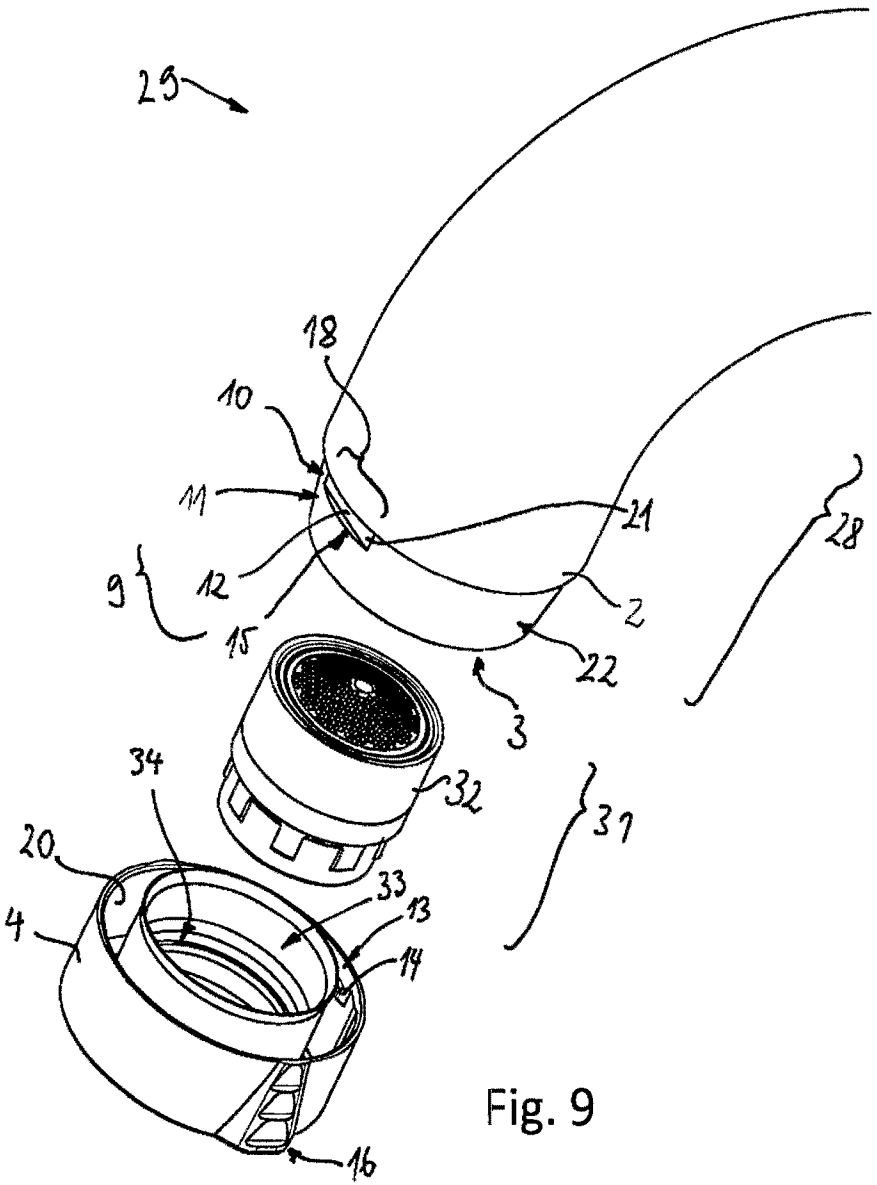
FIG. 9 shows a three-dimensional oblique view of the outlet device as per FIG. 7 in a partially exploded illustration.

FIGS. 7 to 9 show a further exemplary embodiment according to the invention of a sanitary outlet device. Components and functional units which are similar or identical in terms of function and/or construction to the preceding exemplary embodiments are denoted by the same reference designations, and will not be separately described again. The statements relating to the exemplary embodiments above therefore apply correspondingly to FIGS. 7 to 9.

The exemplary embodiment as per FIGS. 7 to 9 differs from the preceding exemplary embodiments at least in that the position of the circumferential portion 18 has been rotated through 90°.

Furthermore, a different jet-altering inner part 31 has been inserted in order to define a jet form or jet quality that differs from that in FIG. 1. For this purpose, the insert 5 cartridge 32 can, as shown in FIG. 9, be easily removed from the removed adapter 4 and exchanged.

Figure 10:
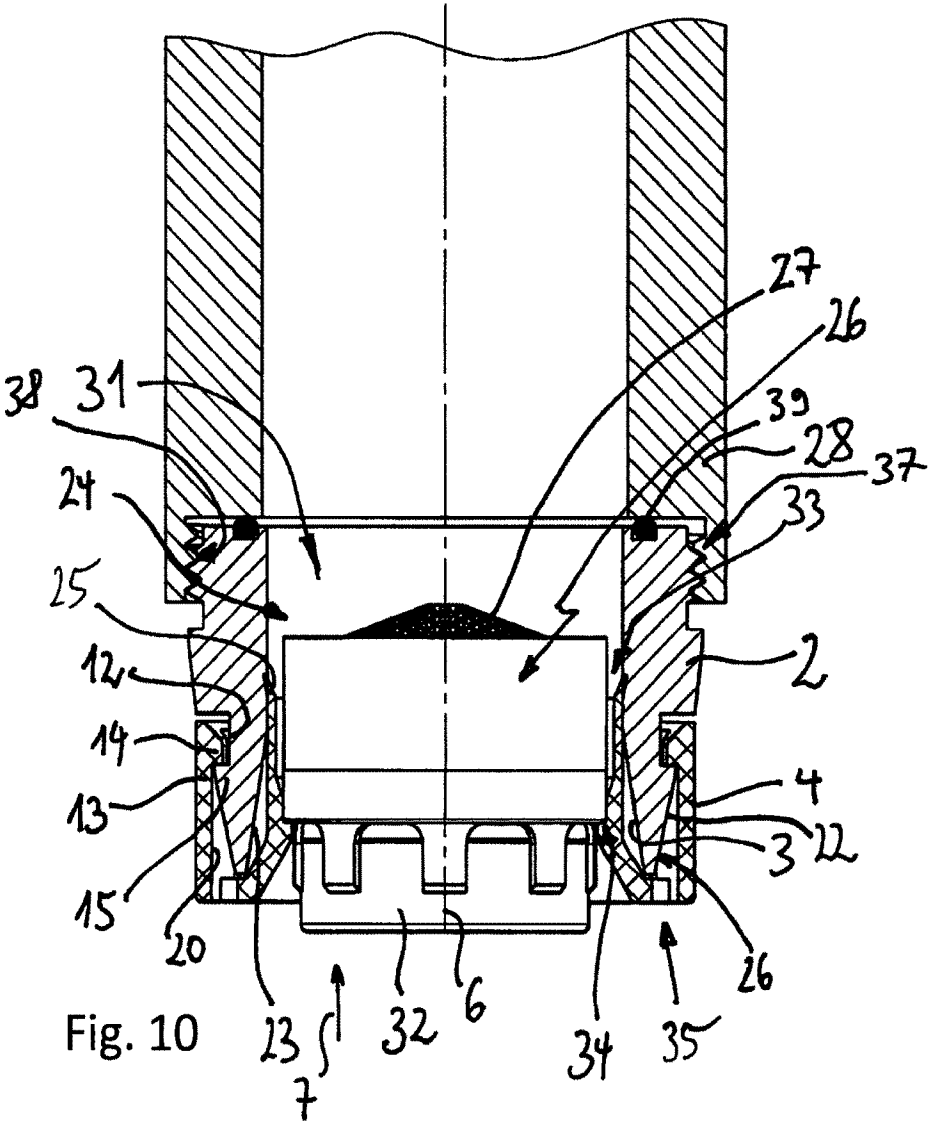
FIG. 10 shows a longitudinal section through a further sanitary outlet device according to the invention.
Figure 11:
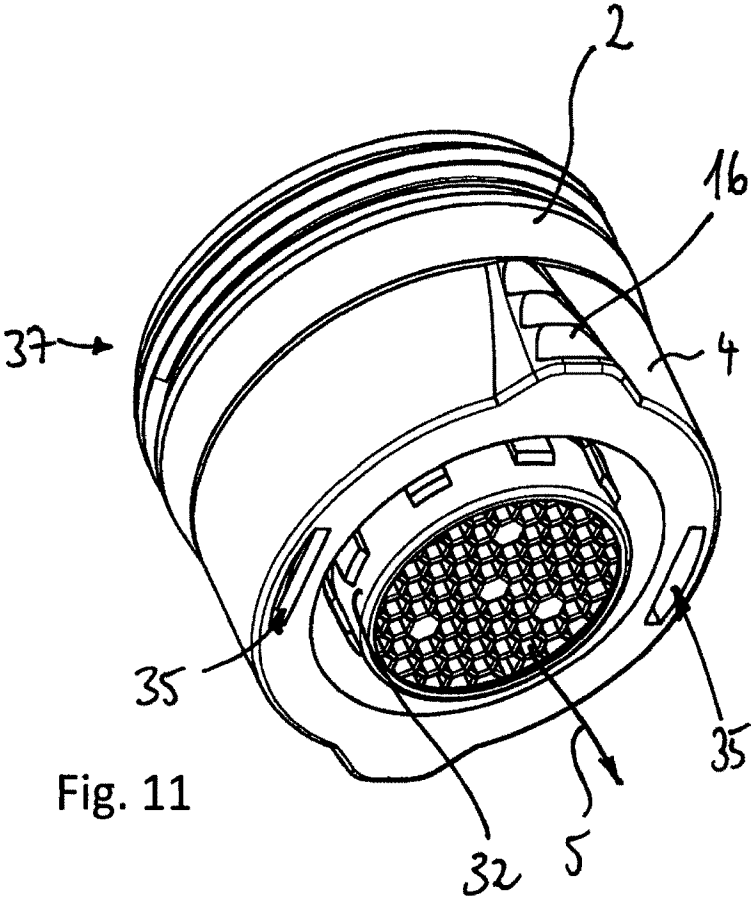
FIG. 11 shows a three-dimensional oblique view from below of the outlet side of the outlet device as per FIG. 10.
Figure 12:
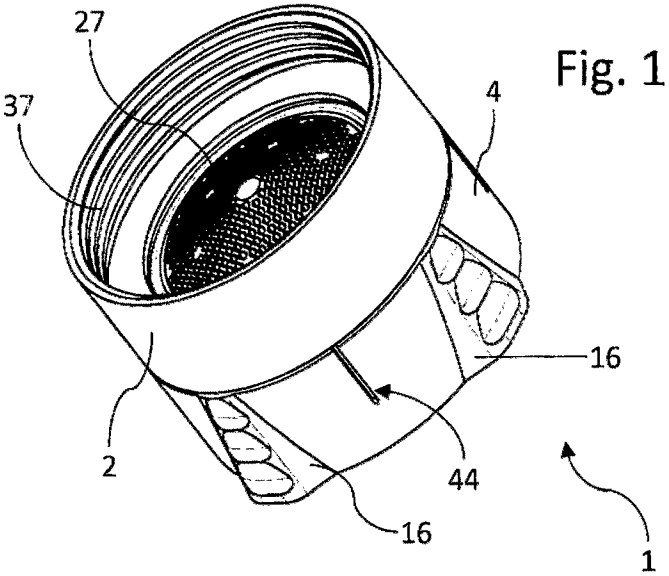
FIG. 12 shows a three-dimensional perspective view from the outside of the inflow side of a further outlet device according to the invention.
Figure 13:
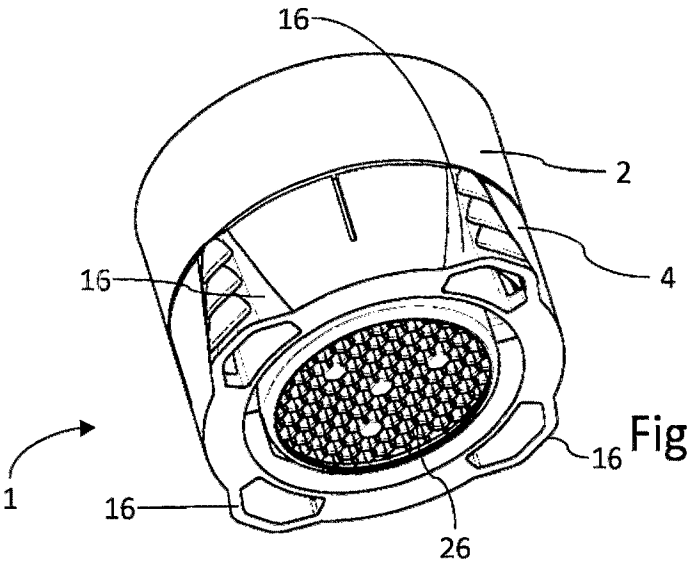
FIG. 13 shows a three-dimensional oblique view from the outside of the outflow side of the outlet device as per FIG. 12.
Figure 14:
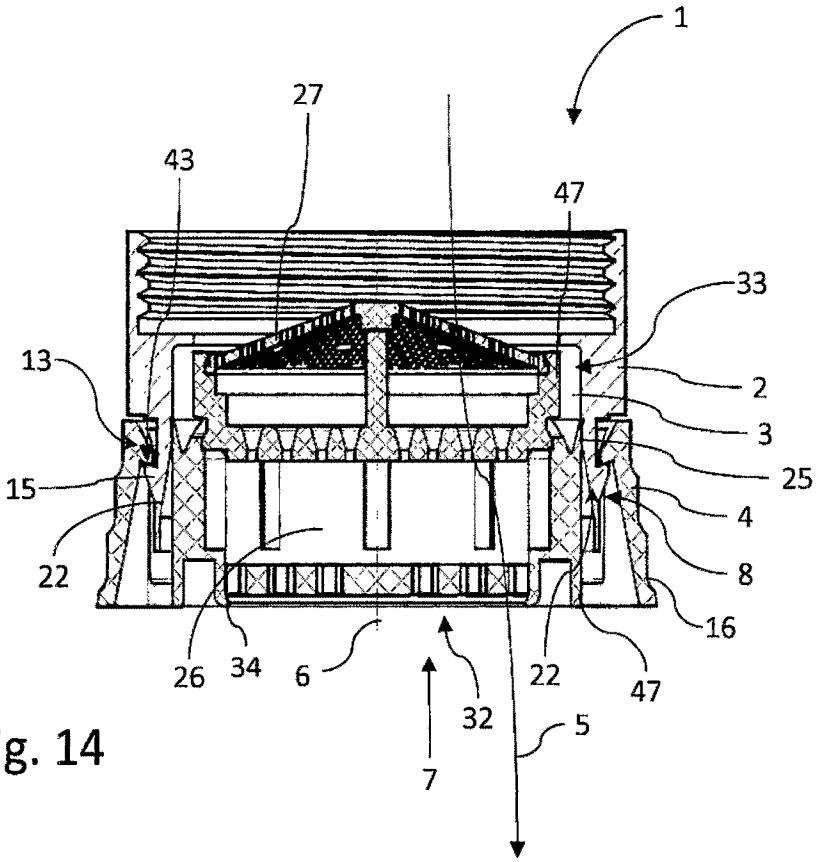
FIG. 14 shows a longitudinal section through the outlet device as per FIG. 12.
Figure 15:
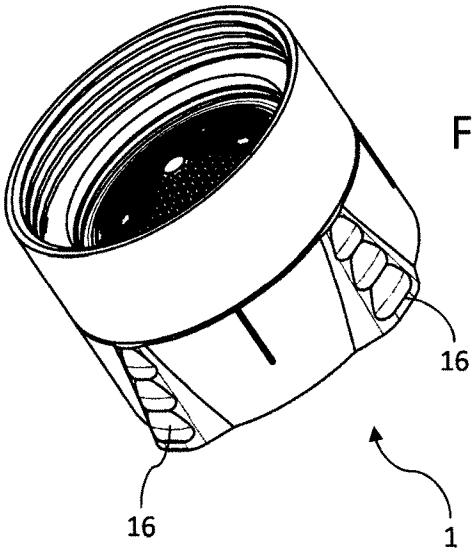
FIG. 15 shows a three-dimensional oblique view from the outside of the inflow side of a further outlet device according to the invention.
Figure 16:
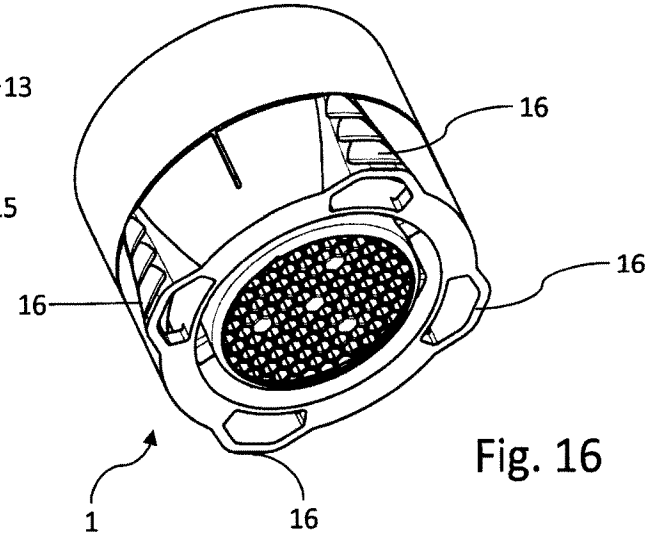
FIG. 16 shows a three-dimensional oblique view from the outside of the outflow side of the outlet device as per FIG. 15.
Figure 18:
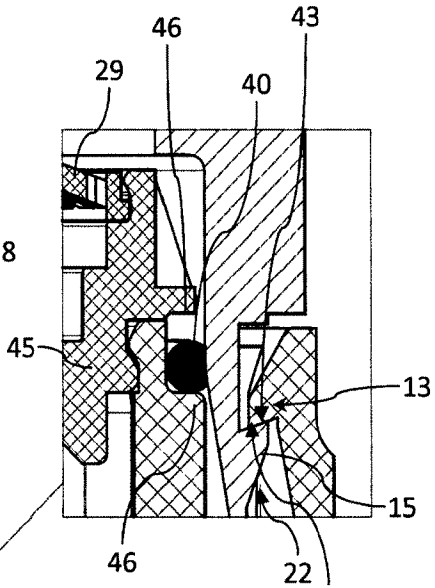
FIG. 18 shows an enlarged detail from FIG. 17.
Figure 17:
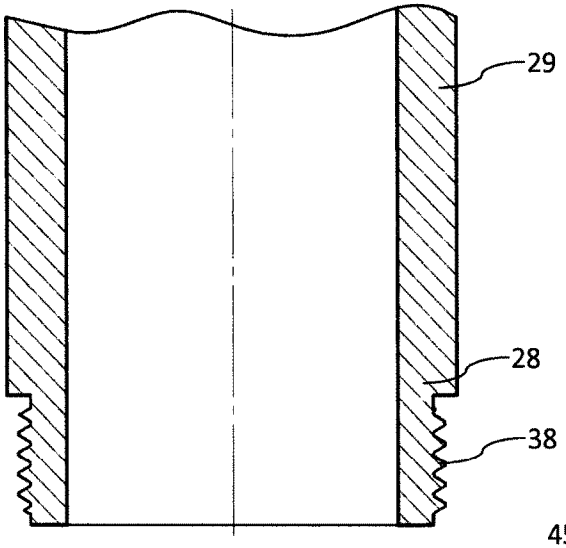
FIG. 17 shows a longitudinal section through the outlet device as per FIG. 15 with a matching fitting outlet.
Figure 17:
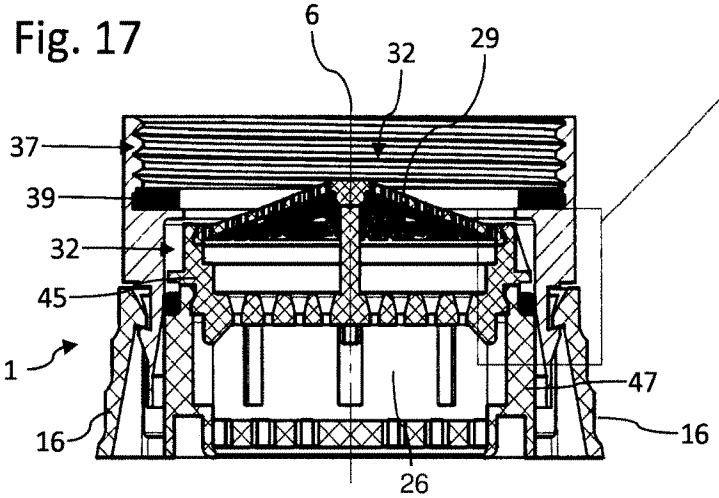

FIGS. 10 and 11 show a further exemplary embodiment according to the invention of a sanitary outlet device. Components and functional units which are similar or identical in terms of function and/or construction to the preceding exemplary embodiments are denoted by the same reference designations, and will not be separately described again. The statements relating to the exemplary embodiments above therefore apply correspondingly to FIGS. 10 and 11.

The exemplary embodiment as per FIGS. 7 to 9 differs from the preceding exemplary embodiments at least in that the housing 3 is formed separately from a fitting outlet 28. In this exemplary embodiment, a thread 37 on the housing 3—in this case and commonly an external thread—is screwed together with a matching counterpart thread 38—in this case and commonly an internal thread—on the fitting outlet 28. A seal 39, which in a use position is enclosed on all sides by the material of the housing 3 and of the fitting outlet 28, imparts a sealing action between the housing 3 and the fitting outlet 28.

Both the housing 3 and the fitting outlet 28 are manufactured from metal or from some other material that impedes or prevents settling of bacteria. The seal 39 may be manufactured from rubber, because contact with flowing water can be practically ruled out.

For the exchange of the adapter 4 and/or of the jet-forming inner part 31, the housing 3 can remain on the fitting outlet 28.

FIGS. 11 to 14 show a further exemplary embodiment according to the invention. Components and functional units which are similar or identical in terms of function and/or construction to the preceding exemplary embodiments are again denoted by the same reference designations, and will not be separately described again. The statements relating to FIGS. 1 to 10 therefore apply correspondingly to FIGS. 11 to 14.

By contrast to the preceding exemplary embodiments, the adapter 4 has, on the outer side, four handling projections 16 which are distributed uniformly in the circumferential direction.

The detent element 13 and the counterpart detent element 15 are in this case formed with undercuts, resulting in a release angle of greater than 90°.

For this purpose, the detent element 13 and the counterpart detent element 15 have matching oblique surfaces 43, which define a release angle of the detent connection of greater than 90°.

Each of the oblique surfaces 43 is thus, in the insertion direction 7, inclined relative to the respectively corresponding oblique surface 43 such that a lateral deflection of the detent element 13 in the presence of a pulling action on the housing 4 (and thus in the presence of a pressure loading owing to the water pressure) is mechanically prevented. The release angle thus effects interlocking of the detent element 13 with the counterpart detent element 15.

An axially oriented slot 44 in the housing 4 serves for providing the required freedom of movement at the detent element 13, in order that these can be pushed over the counterpart detent element 15.

In this exemplary embodiment, the insert cartridge 32 as jet former 26 is assembled from a splitter part 45 and an outlet part 47. Here, the sealing lip 25 projects, counter to the flow direction, from a main body of the outlet part 47.

Here, the outlet part 47 may be formed integrally with, or inserted into, the adapter 4.

FIGS. 15 to 21 show a further exemplary embodiment according to the invention. Components and functional units which are 15 similar or identical in terms of function and/or construction to the preceding exemplary embodiments are again denoted by the same reference designations, and will not be separately described again. The statements relating to FIGS. 1 to 14 therefore apply correspondingly to FIGS. 15 to 21.

The exemplary embodiment as per FIGS. 15 to 21 differs from the preceding exemplary embodiments at least in that, instead of the sealing lip 17, a sealing ring 40, for example an O-ring comprised of rubber, is provided. Owing to its concealed position, the O-ring is not flushed through despite coming into contact with water.

The jet former 26 is again assembled from a splitter part 45 and an outlet part 47. The outlet part 47 may be integrally connected to the adapter 4, or the outlet part 47 is held by the adapter 4.

On the outlet part 47 and the splitter part 45, there is formed in each case one encircling shoulder 46, which shoulders between them receive the sealing ring 40 and hold said sealing ring axially on both sides. The sealing ring 40 can thus be inserted and removed again together with the adapter 4. In further exemplary embodiments, instead of the shoulders 46, there are formed radially protruding projections which hold the sealing ring 40 axially in portions.

Figure 19:
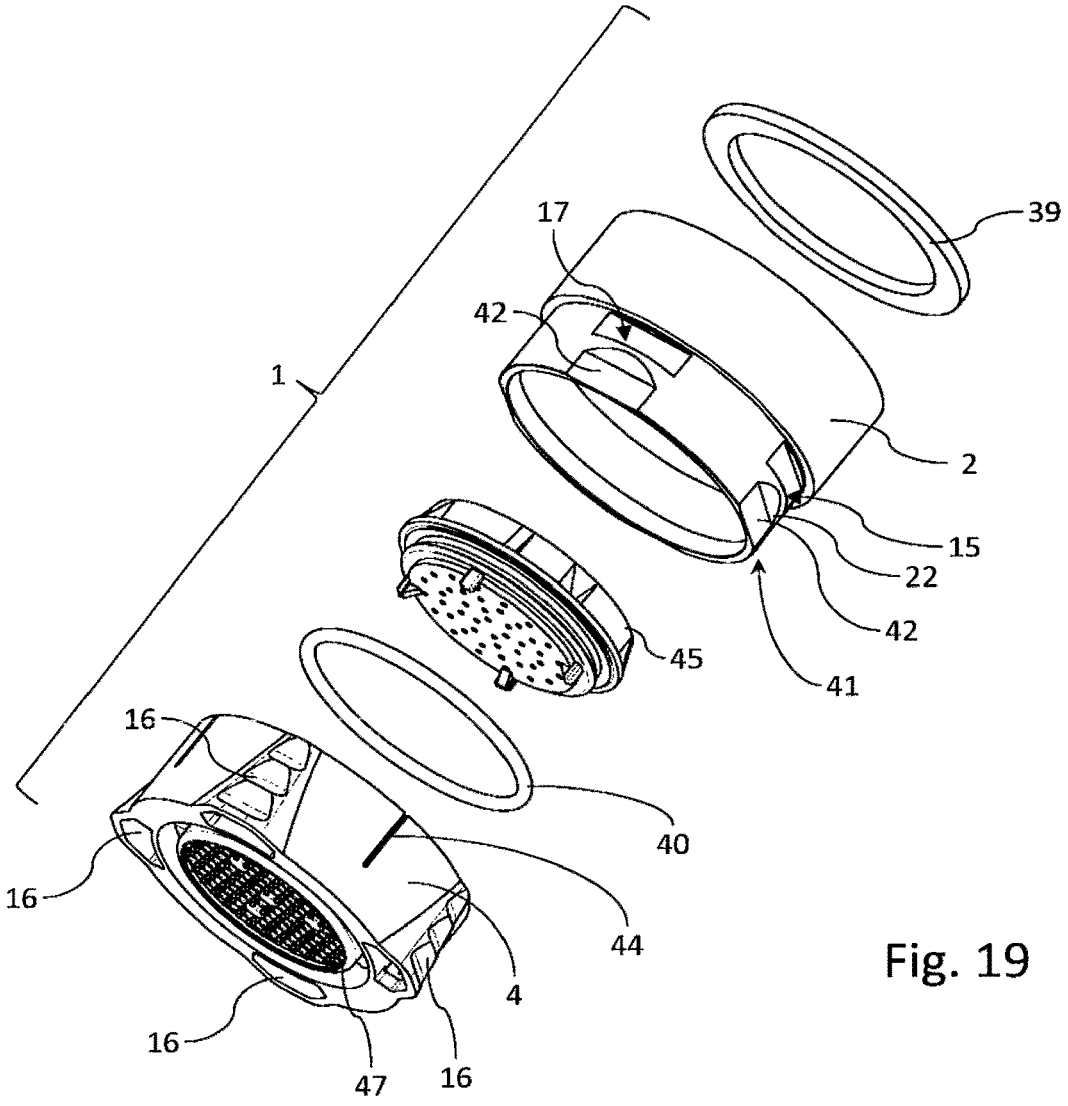
FIG. 19 shows an exploded illustration in relation to FIG. 15.
Figure 20:
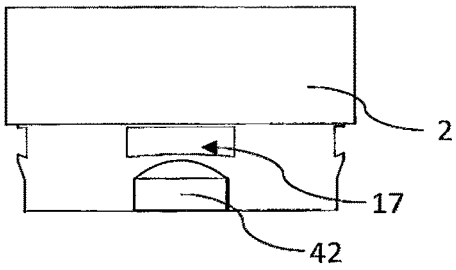
FIG. 20 shows a side view of the housing from FIG. 15.
Figure 21:
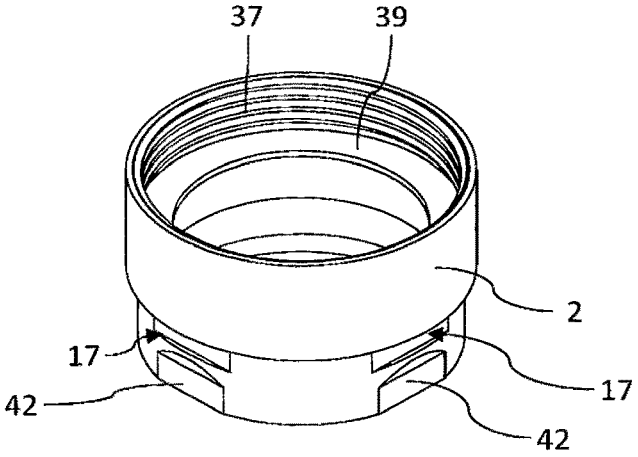
FIG. 21 shows an perspective view of the inflow side of the housing as per FIG. 20.

In FIGS. 19 to 21, it can be seen that the arrangement of four handling projections 16 has a correspondent in the arrangement of the counterpart detent elements 15 (and correspondingly of the detent elements 13).

In further exemplary embodiments, a smaller or greater number of handling projections 16, for example three or five or more than five, is formed.

Situated in front of the counterpart detent element 15 in the insertion direction 7 are mounting aids 41, which in this case have the form of indentations 42. The detent elements 13 are in this case dimensioned such that they are bent apart slightly by the cylindrical portion of the housing 2. A user can thus easily sense when the detent elements 13 pass into the circumferential region of the indentations 42 during a rotation of the adapter 4. This thus constitutes a mounting aid 41, because the detent elements 13 are now aligned in relation to the counterpart detent elements 15 (which in this position are possibly already concealed by the adapter 4) and can be easily mounted onto these.

In the case of the sanitary outlet device 1, it is thus generally provided that a jet former receptacle 3 be formed on a housing 2, in which jet former receptacle an adapter 4 is arranged in a removably inserted manner and so as to be rotatable about its axis of rotation 6, wherein the adapter 4 can be rotated between a fixing position, in which the adapter 4 is secured against being removed, and a releasing position, in which the adapter 4 is removable.

LIST OF REFERENCE DESIGNATIONS

1 Sanitary outlet device
2 Housing
3 Jet former receptacle
4 Adapter
5 Flow path
6 Axis of rotation
7 Insertion direction
8 Outer side
9 Portion
10 Contour
11 Flattening
12 Groove
13 Detent element
14 Detent projection
15 Counterpart detent element
16 Handling projection
17 Groove portion
18 Circumferential portion
19 Detent receptacle
20 Inner surface
21 Detent projection run-on bevel
22 Counterpart detent element run-on bevel
23 Internal cone
24 Inflow-side end
25 Sealing lip
26 Flow regulator, jet aerator, jet former
27 Upstream screen
28 Fitting outlet
29 Fitting

30 Contour run-on bevel
31 Jet-altering inner part
32 Insert cartridge
33 Cartridge receptacle
34 Stop
35 Access opening
36 Guide bevel
37 Thread
38 Counterpart thread
39 Seal
40 Sealing ring
41 Mounting aid
42 Indentation
43 Oblique surface
44 Slot
45 Splitter part
46 Shoulder
47 Outlet part

The invention claimed is:

1. A sanitary outlet device (1), comprising:

a housing (2) with a clear open cross-section, which forms a jet former receptacle (3);

an adapter (4) removably connected to the housing, the adapter (4) defines a flow path (5), the adapter (4) is arranged in the jet former receptacle (3) so as to be rotatable between a fixing position, in which the adapter (4) is locked with the housing (2) and forms a flow resistance in the flow path (5), and a releasing position, in which the adapter (4) is removable from the jet former receptacle (3);

the adapter (4), in the fixing position, is locked with the housing (2) on an outer side (8) of the housing (2), and is released by a rotation of the adapter (4) into the releasing position;

the housing (2) has a noncircular contour (10) on the outer side (8) thereof at least in one portion (9);

a non-penetrating detent connection between the housing (2) and the adapter (4), the non-penetrating detent connection including a non-penetrating detent element (13) located on a surface of one of the housing (2) or the adapter (4), and a non-penetrating counterpart detent element (15) located on a facing surface of the other of the housing (2) or the adapter (4), the non-penetrating detent connection being configured such that a rotation of the adapter (4) relative to the housing (2) forces the non-penetrating detent element (13) out of engagement, or releases said non-penetrating detent element from engagement, with the non-penetrating counterpart detent element (15).

2. The sanitary outlet device (1) as claimed in claim 1, wherein the adapter (4) is insertable into the jet former receptacle (3) in an insertion direction (7) oriented counter to a flow direction of the flow path (5), and is movable out of the jet former receptacle (3) by a flow in the flow path (5).

3. The sanitary outlet device (1) as claimed in claim 2, wherein the adapter (4) is arranged in the jet former receptacle (3) so as to be rotatable about an axis of rotation (6) oriented along the flow path (5), and the fixing position and the releasing position are arranged at a same height in relation to the insertion direction (7) of the adapter (4).

4. The sanitary outlet device (1) as claimed in claim 1, wherein the non-circular contour (10) has at least one of a flattening (11) delimited on a circumferential portion (18) or has a contour run-on bevel (30) running in a circumferential direction.

5. The sanitary outlet device (1) as claimed in claim 1, wherein the adapter (4) has a noncircular form on an outer side to define at least one protruding handling projection (16).

6. The sanitary outlet device (1) as claimed in claim 2, wherein the non-penetrating detent element (13) is a detent projection (14) and the non-penetrating counterpart detent element (15) is a detent receptacle and the non-penetrating counterpart detent element (15) is formed as a groove.

7. The sanitary outlet device (1) as claimed in claim 2, wherein the non-penetrating detent element (13) is formed on an inner surface (20) of the adapter (4), said inner surface has an uninterrupted encircling design, the inner surface (20) defines at least one of an inner diameter or an inner circumference which is adapted to at least one of an outer diameter or an outer circumference of the housing (2), and a mounting aid (41) is formed in front of the non-penetrating counterpart detent element (15) in the insertion direction (7), the mounting aid being axially aligned with the non-penetrating counterpart detent element (15).

8. The sanitary outlet device (1) as claimed in claim 6, wherein the detent projection (14) has a detent projection run-on bevel (21) which is oriented in the insertion direction (7) and adjoins the inner surface (20).

9. The sanitary outlet device (1) as claimed in claim 1, wherein the non-penetrating counterpart detent element (15) is formed on the outer side (8) of the housing (2) and has a counterpart detent element run-on bevel (22).

10. The sanitary outlet device (1) as claimed in claim 1, wherein the jet former receptacle (3) is formed so as to widen in a flow direction.

11. The sanitary outlet device (1) as claimed in claim 1, wherein the adapter (4) is, in the inserted state, deformed at an inflow-side end (24) thereof by the jet former receptacle (3).

12. The sanitary outlet device (1) as claimed in claim 1, wherein the adapter (4) has, at an inflow-side end (24) thereof, an elastic sealing lip (25), which bears against the jet former receptacle (3), or a sealing ring (40), which bears against the jet former receptacle (3) and which is held axially on a jet former (26), or both the elastic sealing lip and the sealing ring.

13. The sanitary outlet device (1) as claimed in claim 1, wherein the adapter (4) is at least one of: manufactured from plastic, has a jet former (26), has a flow regulator (26), or is designed as an aerated adapter (4).

14. The sanitary outlet device (1) as claimed in claim 2, wherein the non-penetrating detent element (13) has at least two detent projections (14) which engage on the housing (2), and the non-penetrating counterpart detent element (15) has at least two detent recesses.

15. The sanitary outlet device (1) as claimed in claim 14, wherein the non-penetrating detent element (13) is formed on an inner surface (20) of the adapter and at least one of the inner surface (20) or the outer side (8) describe a portion of a body of revolution between two detent projections (13) or counterpart detent recesses (15) which are adjacent in a circumferential direction.

16. The sanitary outlet device (1) as claimed in claim 1, wherein the housing (2) has, at an inflow-side end (24) of the flow path (5), a fitting receptacle with a thread, which is adapted to be screwed together with a counterpart thread of a fitting outlet (28).

17. The sanitary outlet device (1) as claimed in claim 1, wherein a jet-altering inner part (31) is detachably inserted as an insert cartridge (32) in the adapter (4).

18. The sanitary outlet device (1) as claimed in claim 1, wherein at least one of the non-penetrating detent element (13) or the non-penetrating counterpart detent element (15) define a release angle of greater than 90°.

19. A sanitary fitting (29) having a sanitary outlet device (1) as claimed in claim 1, wherein the sanitary outlet device (1) is screwed to a fitting outlet (28) of the sanitary fitting (29), or the housing (2) of the sanitary outlet device (1) is formed integrally on the fitting outlet (28) of the sanitary fitting (29).

* * * * *